United States Patent [19]

Stupp et al.

[11] Patent Number: 4,700,113

[45] Date of Patent: Oct. 13, 1987

[54] VARIABLE HIGH FREQUENCY BALLAST CIRCUIT

[75] Inventors: Edward H. Stupp, Spring Valley; Mark W. Fellows, Monroe, both of N.Y.

[73] Assignee: North American Philips Corporation, New York, N.Y.

[21] Appl. No.: 334,996

[22] Filed: Dec. 28, 1981

[51] Int. Cl.[4] ..... H05B 37/02

[52] U.S. Cl. ..... 315/224; 315/208; 315/219; 315/307; 315/DIG. 1; 315/DIG. 7

[58] Field of Search ..... 315/307, 308, 311, DIG. 7, 315/DIG. 2, 219, 224

[56] References Cited

U.S. PATENT DOCUMENTS

| | | | |
|---|---|---|---|
| 3,449,629 | 6/1969 | Wigert et al. | 315/308 |
| 4,060,751 | 11/1977 | Anderson | 315/239 |
| 4,060,752 | 11/1977 | Walker | 315/244 |
| 4,199,710 | 4/1980 | Knoll | 315/205 |
| 4,245,177 | 1/1981 | Schmitz | 315/239 |
| 4,277,728 | 7/1981 | Stevens | 315/307 |
| 4,346,332 | 8/1982 | Walden | 315/224 |

FOREIGN PATENT DOCUMENTS

| | | | |
|---|---|---|---|
| 1017009 | 1/1966 | United Kingdom | 315/DIG. 4 |

*Primary Examiner*—Harold Dixon

*Attorney, Agent, or Firm*—Robert T. Mayer; Bernard Franzblau

[57] ABSTRACT

A variable high-frequency ballast circuit for igniting and operating energy saver discharge lamps includes a high frequency inverter that energizes the lamps with a given high frequency voltage at which reliable lamp ignition is assured. The lamp current is monitored so as to automatically increase the lamp operating frequency to an optimum value as soon as the lamps ignite.

19 Claims, 2 Drawing Figures

VARIABLE HIGH FREQUENCY BALLAST CIRCUIT

BACKGROUND OF THE INVENTION

This invention relates to high frequency operation of an electric discharge lamp and, more particularly, to an improved high frequency ballast circuit for starting and operating a so-called energy saver discharge lamp or the like.

Circuits for starting and ballasting a gas discharge lamp are generally required to provide stable and efficient operation thereof. During normal operation, the discharge lamp exhibits a negative impedance characteristic. A ballast circuit is therefore required in order to provide a positive series impedance or other current limiting mechanism to balance the negative impedance characteristic of the lamp and thereby provide stable operation. The voltage required to initiate a discharge in such a lamp is generally substantially higher than the normal operating voltage of the lamp. An auxiliary starting circuit may be used to provide the high starting voltage to initiate the lamp discharge. The lamp ballasting function has usually been provided by an inductor or resistor connected in series with the discharge lamp.

It is known that high frequency operation of electric discharge lamps provides several unique advantages over low frequency, e.g. 60 Hz, operation thereof. For example, high frequency operation of a discharge lamp provides higher efficacy than low frequency operation while simultaneously permitting the use of reactive components of much smaller size and therefore reduced cost. High frequency operation often results in an improvement in the circuit power factor and a significant reduction of power losses in the ballast.

The typical "energy saver" type of electric discharge lamp normally contains a conductive film or strip on the internal surface of the lamp which allows the lamp to start and operate with a standard 60 Hz supply voltage even though the lamp may have a Krypton-neon or Krypton-argon fill gas. A serious problem with all energy saver type lamps which incorporate this internal conductive film or strip is that they are extremely difficult, if not impossible, to start when used in conjunction with a high frequency ballast. It is believed that at the operating frequencies (approximately 15 KHz–50 KHz) of standard high frequency ballasts, the AC voltage applied across the lamp electrodes is capacitively coupled between the electrodes and the internal conductive coating on the lamp so as to effectively apply a short circuit across the lamp electrodes and thereby prevent ionization of the fill gas within the lamp envelope beyond the vicinity of the electrodes. This occurs because, as the supply frequency is increased, the impedance between each electrode and the conductive wall decreases to a value such that the electrode-to-wall potential drop is insufficient to permit full ionization of the fill gas within the lamp. As a result, the lamp will not ignite. However, in order to obtain maximum efficacy and energy savings with energy saver lamps, it is desirable to operate them by means of high frequency - high efficiency drive circuits provided that a feasible method to start them can be found.

A static inverter for operating a gas discharge lamp, in which the inverter will oscillate at a first frequency during the lamp pre-ignition period (e.g. 22 KHz) and then will automatically increase its oscillating frequency to approximately 27 KHz during normal operation of the lamp, is described in U.S. Pat. No. 4,245,177 issued Jan. 13, 1981 in the name of N. A. Schmitz. However, the inverter disclosed therein is not concerned with the special problems involved in the high frequency ignition of energy saver type discharge lamps. Nor is there any indication that the cause of the aforesaid ignition problem was even recognized, or its solution even a remote consideration in the design of the Schmitz static inverter.

In U.S. Pat. No. 4,060,751 issued Nov. 29, 1977 to T. E. Anderson, there is described a dual mode solid state inverter circuit for starting and ballasting a gas discharge lamp. Before ignition of the discharge lamp, an AC inverter operates at the resonant frequency of a series resonant LC circuit so that a ringing voltage developed across the capacitor builds up to a level sufficient to ignite the lamp. Subsequently, the inverter frequency is controlled as a function of the load current sensed by a current detector so as to limit the lamp current and thereby provide the normal ballast function required by a discharge lamp. Other variable frequency inverter circuits for regulating the current in a discharge lamp are described in U.S. Pat. No. 4,220,896 issued Sept. 2, 1980 to D. A. Paice and in U.K. Patent 1,578,037 published Oct. 29, 1980 in the name of L. H. Walker.

SUMMARY OF THE INVENTION

Accordingly, it is an object of the present invention to provide an improved method and apparatus for the high frequency ignition and operation of an energy saver type discharge lamp or the like.

Another object of the invention is to provide a novel variable high frequency discharge lamp ballast circuit which generates a first high frequency voltage at a frequency well above 60 Hz but below the standard high frequency ballast operating range (approximately 15 KHz–50 KHz) in order to promote ignition of the lamp.

It is a further object of the invention to provide an improved discharge lamp ballast circuit which generates a first appropriate high frequency voltage for lamp ignition and then automatically generates a second higher high frequency voltage appropriate for normal operation of the lamp.

A still further object of the invention is to provide an improved high frequency ballast circuit for deriving a high frequency operating voltage for a discharge lamp which is substantially higher than the high frequency generated during the lamp ignition period.

A further object of the invention is to provide an improved high frequency ballast circuit that automatically generates optimum ignition and operating frequencies for an energy saver type discharge lamp.

Another object of the invention is to provide a driven non-resonant inverter circuit for operating a discharge lamp via a reactive ballast impedance.

An additional object of the invention is to provide a variable high frequency drive to the operating lamp so as to provide constant lamp current under various operating conditions.

A further object of the invention is to provide a variable high frequency drive to the operating lamp in order to provide different operating lamp currents to effect lamp dimming.

Yet another object of the invention is to provide a novel variable high frequency ballast circuit that is lightweight, compact, and exhibits a high efficiency.

These and other objects of the invention are achieved by providing a variable high frequency ballast circuit with means for generating a high frequency ignition voltage for the discharge lamp at a first frequency $f_s$ that is suitable for reliable lamp ignition and which is well above the available 60 Hz AC supply voltage, but is still well below the customary high frequency operating range for the discharge lamp. The high frequency $f_s$ is chosen so that reliable ignition of an energy saver type lamp is achieved. The ballast circuit further comprises means for monitoring the lamp current and for automatically advancing the operating frequency thereof as soon as it senses a current flow through the lamp of an amplitude indicating that the lamp is in operation (ignited). Means are provided to automatically adjust the operating frequency during lamp operation to maintain the lamp current constant at the desired level for full light output or at a reduced light output.

BRIEF DESCRIPTION OF THE DRAWINGS

The novel and distinctive features of the invention are set forth in the appended claims. The invention itself, together with further objects and advantages thereof, may best be understood by reference to the following detailed description thereof taken in conjunction with the accompanying drawings, in which:

FIG. 1 of the drawing provides a functional representation of a preferred embodiment of the invention, partly in block diagram and partly in schematic circuit form. The novel ballast circuit may be connected to a pair of low frequency (e.g. 60 Hz) AC input terminals 1, 2 for supplying power to energize the ballast circuit and discharge lamps. Alternatively, the input terminals could provide a DC supply voltage for the apparatus.

Figure 1:
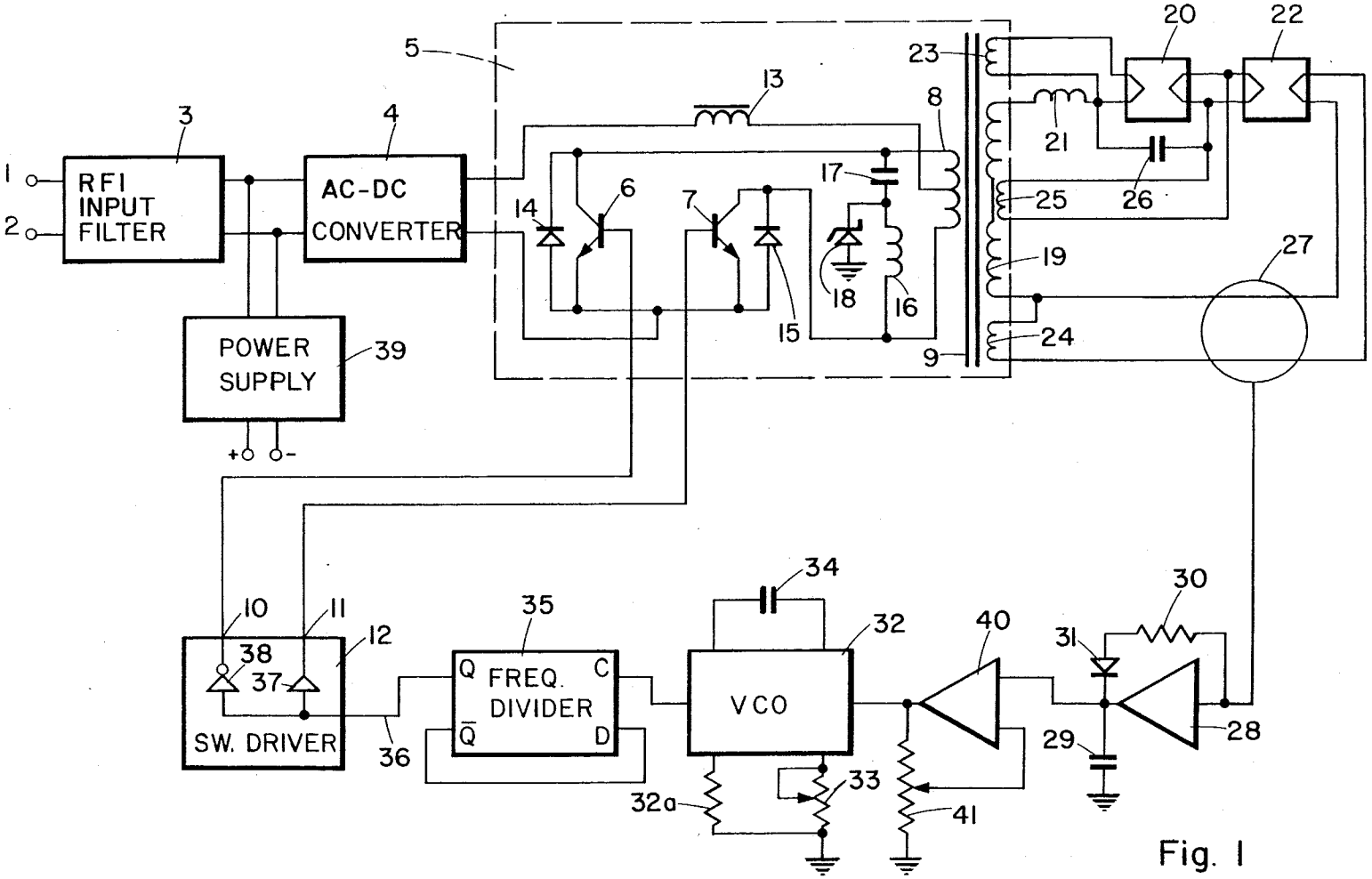
FIG. 1 shows a first embodiment of the invention.

Coupled to the input terminals is a passive radio frequency interference filter 3 that is conventional for use in a high frequency ballast system. Coupled to the output of the RFI filter 3 is an AC-DC converter device 4, also of conventional design. The converter device 4 includes a rectifier circuit and filter capacitor along with circuit means for providing a high power factor and control of the harmonic content of the currents.

The DC supply voltage generated in the power supply 4 is coupled to a DC-high frequency converter device 5 that includes a push-pull inverter and an impedance matching transformer. The push-pull inverter consists of switching power transistors 6 and 7 having collector electrodes connected to opposite ends of primary winding 8 of a transformer 9. The base electrodes of transistors 6 and 7 are connected to output terminals 10 and 11, respectively, of a switch driver circuit 12. The center tap of the primary winding 8 is coupled to the positive output terminal of the power supply 4 via a small, low value choke coil 13. The emitter electrodes of switching transistors 6 and 7 are connected together and to the negative supply terminal of the power supply.

Clamping diodes 14 and 15 are connected in anti-parallel circuit configuration with transistors 6 and 7, respectively, in order to protect the transistors from excessive voltages. An inductor 16 and a capacitor 17 are serially connected across the end terminals of the primary winding 8. A Zener diode 18 is connected between the junction point of inductor 16 and capacitor 17 and the circuit ground. Elements 16–18 together constitute a clamping circuit which removes voltage spikes from the transformer caused by the current flowing therein.

A secondary winding 19 of the transformer has one end terminal coupled to one filament electrode of a first discharge lamp 20 via a current limiting inductor 21. The other end terminal of secondary winding 19 is coupled to one filament electrode of a second discharge lamp 22. The other filament electrodes of lamps 20 and 22 are connected together so that the lamps are connected in series circuit with the ballast coil 21 across the end terminals of the secondary winding of transformer 9. The transformer further comprises filament heater windings 23 and 24 coupled to the outermost filament electrodes of the lamps 20 and 22, respectively. A further filament heater winding 25 is coupled to the interconnected filament electrodes of the two discharge lamps. A start capacitor 26 is connected in parallel with the discharge lamp 20 in order to promote sequential ignition of the lamps. The discharge lamps are energy saver lamps or the like.

The total lamp current is monitored by means of a current sensor, e.g. a current transformer or other known current measuring device, illustrated schematically by means of the current loop wire 27 magnetically coupled to the wires that carry the lamp current. When the lamps ignite, a high frequency AC current proportional to the lamp current is coupled via current transformer 27 to the input of a first "741" type of operational amplifier (OP-AMP) 28 which operates as a current to voltage transducer. The high frequency AC current input signal to OP-AMP 28 is converted into a proportional DC voltage across the capacitor 29 coupled to the output of the OP-AMP. The resistor 30 and the diode 31 connected in series across the OP-AMP assist in the conversion of the input AC current into a proportional DC output voltage across capacitor 29.

A buffer amplifier stage 40 provides a scaling function for the sensed lamp current. A potentiometer 41 is coupled between the output of the buffer amplifier and ground and is used to set the level of the DC output signal to be supplied to the control input of the voltage controlled oscillator (VCO) 32. The amplifier 40 may also comprise a "741" OP-AMP. The potentiometer 41 can be used to achieve the dimming operation. The VCO is a conventional integrated circuit and may comprise one-half of a standard "4046" type of circuit that is manufactured by several different integrated circuit manufacturers, such as RCA, Motorola, Fairchild, etc. Resistors **32*a* and 33, together with a capacitor 34, adjust or set the lowest operating frequency ($f_s$) or starting point of the voltage controlled oscillator and also set the absolute frequency range thereof. With a zero input voltage, a frequency $f_s$ is generated that is dependent on the ratio of resistor 33 to resistor 32*a*. The variable resistor 33 is adjusted so that a frequency $f_s$ is generated that will allow reliable ignition of the energy saver lamps 20 and 22. The frequency $f_s$ will be determined by the type of lamp used and the particular characteristics thereof, such as lamp diameter, gas fill, etc. As the DC input voltage to the VCO rises, the frequency of the output pulses supplied to the clock input (c) of a frequency divider 35** will also increase.

The output of the VCO feeds one-half of a conventional "4013" integrated circuit which provides a reduction in a manner similar to that of a phase lock loop circuit.

As in the circuit of FIG. 1, AC power is supplied to input terminals 1 and 2, is filtered in RFI filter stage 3 and then rectified and filtered in the AC-DC conversion stage 4. The filtered DC voltage is converted into a high frequency AC signal within the driven push-pull inverter device 5.

The frequency of operation of the inverter again is determined by the VCO 32. At zero lamp current, i.e. prior to ignition, the output frequency of the switch driver 12 is the ignition freqeuency $f_s$ and is set by the choice of resistors 32*a* and 33 and capacitor 34 in the VCO. The resistance value of resistor 33 relative to that of resistor 32*a* provides a frequency offset which sets both the minimum and the maximum frequencies of operation. Resistor 32*a* and capacitor 32 set the fundamental frequency operating range which will vary from the minimum frequency at a zero input voltage at pin 9 of the VCO (4046 circuit), to a maximum operating frequency at the maximum output voltage delivered by the loop filter 44. This voltage is of course determined by the output level from pin 13 of the phase detector 43. The loop filter and phase detector operate together as a difference driven sample and hold circuit.

The lamp current is again monitored by means of a current sensor 27 and is fed into pin 14 of the phase detector. For a zero lamp current the input is zero so that the resultant output of the loop filter is zero. When the lamp ignites, a lamp current flows which is limited by the ballast reactance 42 in series with the lamp. The choice of circuit parameters for the VCO 32 and the ballast element 42 set the design operation frequency of the system.

For a given design frequency of operation the lamp current will be fixed, thus providing an input signal to pin 14 of the phase detector 43 (4046 circuit). This will in turn result in a DC voltage level at the output of the loop filter 44 which will drive the VCO to the desired operating point. The divide by N frequency divider 35 should preferably contain an even number of stages. Once the correct lamp operating current is achieved, the closed loop logic circuit will vary the operating frequency as necessary to maintain this value of current.

The circuit of the present invention functions as a solid state variable frequency ballast to limit the current of one or more gas discharge lamps operating at a high frequency, i.e. above 15 KHz, and also provides reliable ignition of energy saver type discharge lamps by applying thereto a predetermined high frequency voltage $f_s$ well above 60 Hz but below the conventional operating frequencies of so-called high frequency ballasts. The predetermined frequency $f_s$ is chosen so as to provide reliable ignition of the discharge lamp or lamps within the system design parameters, e.g. the range of AC line voltages, expected temperature variations and the like. After the discharge lamp is ignited, the circuit automatically advances the frequency to the optimum operating design frequency for efficient and reliable high frequency operation of the lamps and then provides further frequency control in a sense to maintain the lamp current constant for the desired light output.

The invention has been described in detail herein in accordance with a preferred embodiment thereof. It will be evident, however, that many modifications and alterations may be affected by persons skilled in the art without departing from the spirit and scope of the invention. For example, a ballast capacitor may be used instead of a ballast inductor, or the discharge lamps may be connected in parallel, rather than in series, as shown herein. It is therefore to be understood that the appended claims are intended to cover all such modifications and variations as fall within the true spirit and scope of the invention.

What we claim is:

1. A circuit for starting and ballasting at least one gas discharge lamp of the type exhibiting a poor starting characteristic at a desired high operating frequency for the lamp and with a given lamp energization voltage comprising, an inverter circuit including first and second switching transistors each having a control electrode, a reactive ballast impedance coupling an output terminal of the inverter circuit to said discharge lamp, means for sensing the flow of current through said discharge lamp and for deriving a control signal determined thereby and indicative of the condition of the lamp, a variable frequency drive circuit for deriving an output signal whose frequency is determined by the value of an input signal applied to a control input thereof, means coupling said control signal to the control input of the variable frequency drive circuit, second means coupling said output signal of the variable frequency drive circuit to the control electrodes of said first and second switching transistors to control the conduction thereof so that the transistors conduct in mutually exclusive time intervals, and means for adjusting the frequency of said variable frequency drive circuit to a predetermined frequency value when said sensing means indicates that the lamp is in an unlit condition and for automatically increasing the frequency thereof to the desired operating frequency when the sensing means derives a control signal indicating that the lamp is in its operating condition, said frequency value being chosen to be above 60 Hz and below the desired high operating frequency of the discharge lamp and being of a frequency such that said given energization voltage provides reliable ignition of the discharge lamp.

2. A circuit as claimed in claim 1 wherein said inverter circuit includes a transformer having primary and secondary windings with collector electrodes of the first and second switching transistors connected to first and second end terminals of the primary winding, respectively, and said ballast impedance comprises an inductor connected in series with the discharge lamp across the secondary winding.

3. A circuit as claimed in claim 1 wherein said inverter circuit includes a transformer having primary and secondary windings with the first and second transistors coupled to the primary winding in a push-pull arrangement so as to provide a square wave current in said primary winding, and said ballast impedance comprises an inductor connected in series with the discharge lamp across the secondary winding to form a non-resonant load for the transformer.

4. A circuit as claimed in claim 1 which includes a gas discharge lamp comprising an energy saver low pressure mercury vapor discharge lamp having a wall that tion in frequency dependent on the number of frequency reduction stages that are connected together in cascade. In the present case a single stage is sufficient and thus produces a reduction in frequency by one-half, i.e. it functions as a divide-by-two circuit. Additional stages may be used, as required. The square wave output current of the frequency divider 35 is coupled via a line 36 to an input of the switch driver circuit 12. The switch driver boosts the level of the input current signal so as to provide sufficient current to drive the power semiconductor switches 6 and 7 of the driven inverter circuit 5. As it is desired that the switching transistors conduct alternately in mutually exclusive time intervals, the switch driver circuit 12 may, in its simplest form, consist of a non-inverting amplifier 37 and an inverting amplifier 38 for coupling the square wave input signal 180° out of phase to the base electrodes of transistors 7 and 6, respectively, so that at any given instant of time one transistor switch will be on and the other one will be off. It may be desirable to produce a finite delay to insure that one switch will always be off when the other switch is on.

A regulated power supply 39 having its input terminals coupled to the output terminals of the RFI input filter 3 is provided for suppling regulated DC voltages to energize the logic circuitry. The power supply 39 may be a conventional current pump circuit that provides lossless DC power from the AC line for operation of all logic circuitry. The type of power supply used to energize the logic circuitry is not critical to the operation of the invention.

In operation, when the input terminals 1 and 2 are first connected to a source of AC supply voltage, for example, a 115 volts, 60 Hz AC supply, there will then be a zero lamp current. The DC input signal voltage to the VCO 32 will be at level such that the VCO generates output pulses at twice the desired lamp ignition frequency, $f_s$. By means of the divide by two frequency divider 35 and the switch driver circuit 12 the switching transistors 6 and 7 are alternately driven into conduction and cut-off at the ignition frequency, $f_s$. When the transistor 6 is turned on, transistor 7 is turned off, and vice versa. The frequency $f_s$ will generally be the highest frequency at which reliable ignition of the two energy saver lamps 20 and 22 can be guaranteed over the required temperature and input voltage ranges and with a lamp voltage that meets safety limits. The power transistors 6 and 7 will operate as a push-pull, direct driven inverter circuit to supply an ignition voltage of frequency $f_s$ to the energy saver lamps via the transformer 9.

As soon as the lamps ignite a high square wave of current will flow in the secondary circuit of the transformer. In practice, the lamp current waveform will be distorted somewhat so that it does not appear as a pure square wave. The current to voltage converter 28 responds immediately, within two cycles, to the flow of lamp current so as to increase the level of the DC voltage across capacitor 29. The VCO 32 in turn responds to the increase in its DC input signal to increase its frequency and thereby increase the inverter frequency in a direction toward the design operating frequency $f_o$ of the system. The frequency divider 35 ensures the production of a symmetrical output waveform thereby minimizing the generation of even order harmonics. In addition, variations in lamp current, which are phase shifted approximately ±90° from the drive, will alter the VCO at twice the operating frequency. Thus, a frequency change will occur in the circuit only at the completion of a full cycle of the frequency. This results in a cycle-by-cycle frequency control. The reactance of the ballast component, that is the inductor 21, will therefore also vary on a cycle-by-cycle basis. As the frequency increases from the ignition frequency $f_s$, the reactive impedance of ballast inductor 21 increases and thereby reduces the level of the lamp current.

The frequency of the VCO increases until the desired operating frequency is reached and thereby the design operating current level of the discharge lamps. The circuit will now control the lamp current around the design point. For example, if the lamp current tends to rise above the design level, the current is monitored by means of the current transformer 27 and the current to voltage transducer 28 and produces an increase of the DC input signal to the VCO 32. The VCO in turn increases its frequency and thereby increases the frequency of the inverter 5. The higher frequency current that flows increases the reactive impedance of the ballast inductor 21 which tends to limit or reduce the lamp current back to its nominal operating value. The reverse action takes place when the lamp current tends to drop below the design level. In this way, the frequency is changed to vary the ballast impedance in a sense to regulate or maintain the lamp current constant.

The level which is held constant by this control circuit is set by potentiometer 41. By adjusting the setting of this potentiometer, light outputs less than the maximum level can be achieved, i.e., the lamps can be dimmed.

Figure 2:
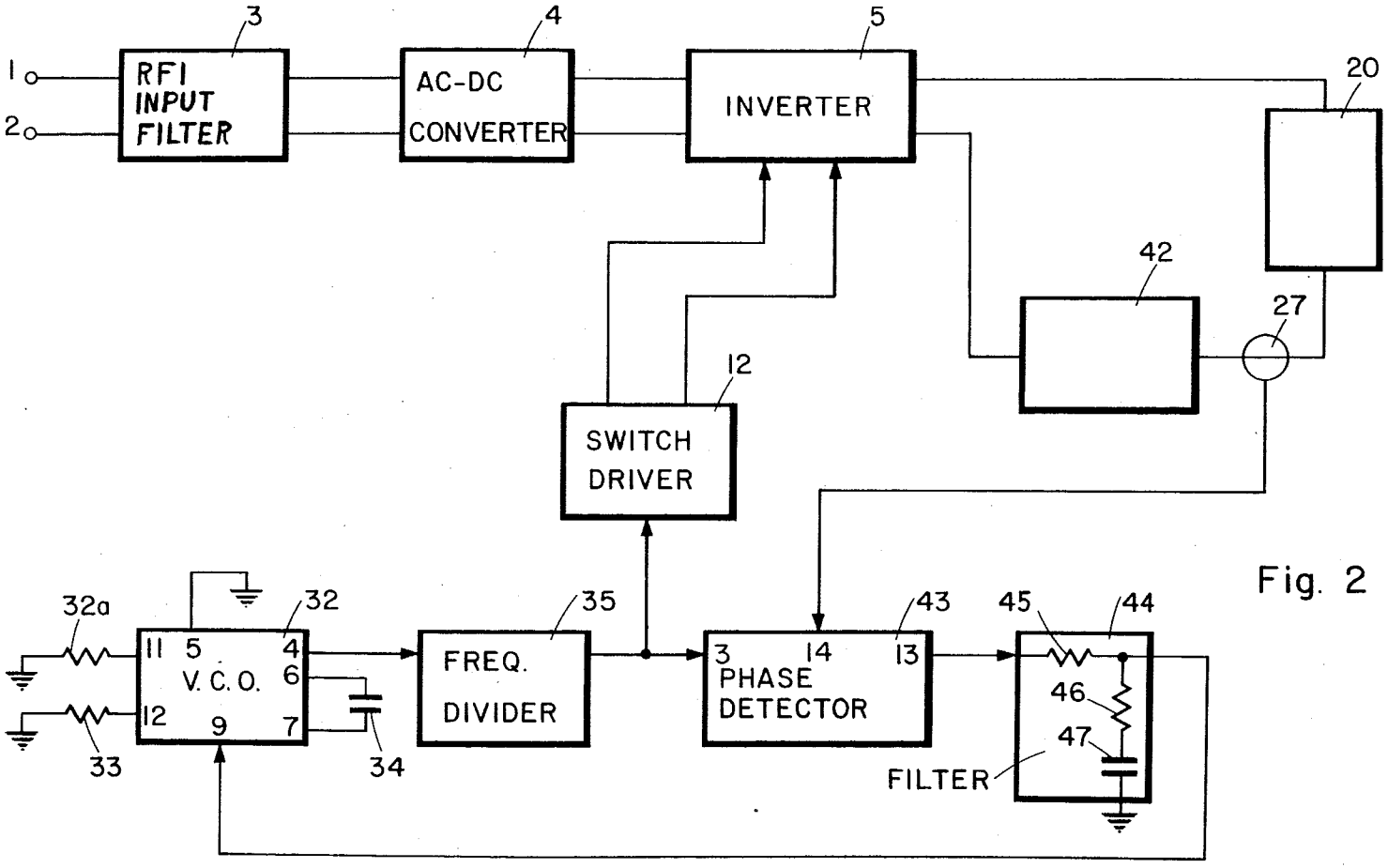
FIG. 2 shows a second embodiment of the invention.

FIG. 2 illustrates a second embodiment of the invention in which elements similar to those described in connection with FIG. 1 have been given the same reference numerals. Input terminals 1 and 2 connect the system to a source of 115 Volts, 60 Hz AC supply voltage. An RFI filter 3 couples terminals 1 and 2 to a power supply 4 which, in turn, supplies the filtered DC operating voltages for the driven push-pull inverter circuit 5. The inverter circuit energizes the discharge lamp 20 via a series connected ballast element 42.

The current loop circuit 27 supplies a reference signal to one input of a phase detector 43. The phase detector may conveniently be a part of the "4046" circuit of which the VCO 32 is another part. The pin numbers of the 4046 circuit are indicated in the drawing. Pin 14 of the 4046 circuit receives the reference input signal. Pin 13 couples the output of the phase detector 43 to an input of a loop filter 44 that may consist of a resistor 45 connected in series with a resistor 46 and a capacitor 47 to ground. Resistor 46 will be approximately ten times the resistance of resistor 45.

The junction point between resistors 45 and 46 constitutes the output terminal of filter 44 and is coupled to pin 9 of the VCO 32 to supply thereto a voltage proportional to frequency. Resistors **32*a* and 33 are connected between pins 11 and 12, respectively, of the VCO and ground. Capacitor 34 is coupled between pins 6 and 7 of the VCO and pin 5** thereof is connected to ground.

Pin 4 of the VCO couples the variable frequency signal to the frequency divider 35 which in turn couples the frequency divided signal to a second input of the phase detector 43, i.e. pin 3 of the 4046 circuit, and to the input of the switch driver circuit 12. The switch driver in turn drives the switching power transistors (not shown in FIG. 2) in the inverter stage 5. The closed loop circuit including elements 32, 35, 43, 44 etc. funcdefines a discharge space and a conductive strip on an inside surface of said wall, and means for coupling said lamp to the ballast impedance.

5. A circuit as claimed in claim 1 wherein said second coupling means includes means for deriving first and second drive signals 180° out of phase, and means for applying said first and second drive signals to the control electrodes of said first and second switching transistors, respectively.

6. A circuit as claimed in claim 1 including means for adjusting the frequency of said variable frequency drive circuit so as to adjust the level of the operating lamp current to a value below the maximum allowed current.

7. A circuit as claimed in claim 2 further comprising, a pair of input terminals for connection to an AC source of voltage at a frequency of approximately 60 Hz, an AC-DC converter having an input coupled to the input terminals and an output terminal coupled to a center tap of said transformer primary winding via a second inductor for supplying a DC voltage to the inverter, and wherein said first and second switching transistors are connected in a push-pull arrangement.

8. A circuit as claimed in claims 1 or 2 wherein said variable frequency drive circuit includes a frequency controlled oscillator whose frequency is determined by the control signal, said oscillator including at least one variable impedance element for adjusting the oscillator to said predetermined frequency value and for setting the frequency range thereof.

9. A circuit as claimed in claim 3 wherein said second coupling means includes a frequency divider circuit coupled between an output of the oscillator and the control electrodes of the switching transistors.

10. A circuit as claimed in claims 1 or 2 wherein the current sensing means includes means connected in series circuit with the discharge lamp and responsive to the lamp current and means for developing a DC voltage proportional thereto and which forms said control signal.

11. A circuit as claimed in claims 1 or 2 wherein the current sensing means includes a current transformer having a primary winding connected in series circuit with a discharge lamp and a secondary winding, and a current-to-voltage transducer having an input coupled to said secondary winding of the current transformer and an output coupled to the control input of the variable frequency drive circuit to supply a DC control voltage thereto independent of ambient light and determined by the level of the lamp current.

12. A circuit as claimed in claims 1 or 2 wherein the current sensing means produces a first control signal so long as the lamp current is below a value indicating that the lamp is in a pre-ignition state and produces a second variable control signal when the lamp current is at or above a value indicating that the lamp is in operation.

13. A circuit as claimed in claims 1 or 2 wherein said variable frequency drive circuit comprises, a phase detector having a first input for receiving said control signal from the sensing means via said first coupling means, a frequency controlled oscillator whose frequency is determined by an input signal applied to an input terminal, and a filter coupled between an output of the phase detector and said oscillator input terminal, and wherein said second coupling means couples an output terminal of the oscillator to a second input of the phase detector.

14. A control apparatus for energizing a gas discharge lamp of the type requiring a high ignition voltage in a desired high frequency operating range of the lamp and which, at a predetermined high frequency below the minimum operating frequency in said desired high frequency range and above 60 Hz, requires a lower ignition voltage to ensure reliable ignition of the discharge lamp, said control apparatus comprising:

a driven inverter circuit including first and second switching transistors and input switching control means, a reactive ballast impedance coupling an alternating voltage developed in the inverter circuit to said discharge lamp, means for sensing lamp current, a variable frequency drive circuit coupled between the sensing means and the inverter circuit input control means for deriving a variable frequency control signal whose frequency is determined by the lamp current sensed and which signal controls the inverter circuit switching frequency, and means controlled by the sensing means for adjusting the frequency of the variable frequency drive circuit to said predetermined high frequency before ignition of the lamp whereby application of said lower ignition voltage to the discharge lamp by the inverter circuit ignites the lamp, said sensing means being responsive to the lamp current after lamp ignition to cause the variable frequency drive circuit to increase the frequency of said variable frequency control signal to said desired high frequency operating range.

15. A control apparatus as claimed in claim 14 further comprising a discharge lamp comprising an energy saver lamp having a conductive coating on the inside of a wall of the lamp that defines a discharge space, and wherein said discharge space includes a Krypton fill gas.

16. A control apparatus as claimed in claim 14 wherein the current sensing means produces a first signal so long as the lamp current is below a value indicating that the lamp is in a pre-ignition state and produces a second signal that varies as a function of the lamp current when the lamp current is at or above a value indicating that the lamp is in operation.

17. A control circuit for energizing at least one gas discharge lamp of the type exhibiting an unreliable starting charateristic at a desired high operating frequency and at a given lamp energization voltage comprising:

a inverter circuit including first and second switching transistors, a non-resonant coupling network including a reactive ballast impedance coupling an output of the inverter circuit to said discharge lamp, means for deriving a control signal determined by the discharge condition of the lamp, a variable frequency drive circuit having an output coupled to a control input of the inverter circuit and responsive to said control signal for developing an output signal whose frequency is determined by the control signal, and wherein said control signal deriving means controls the frequency of said variable frequency drive circuit to a predetermined frequency value when the lamp is in a pre-ignition state whereby said given energization voltage is now sufficient to initiate a lamp discharge, said predetermined frequency value being chosen to be above 60 Hz and below the desired high operating frequency of the discharge lamp.

18. A control circuit as claimed in claim 17 adapted to energize an energy saver lamp of the type having a conductive coating on an inside surface of a wall that defines the lamp discharge space, and wherein said control signal deriving means is responsive to lamp current for controlling the variable frequency drive circuit to increase the frequency of its output signal to said high operating frequency upon ignition of the discharge lamp.

19. A control circuit as claimed in claim 17 wherein said control signal deriving means is responsive to lamp current for controlling the variable frequency drive circuit to vary the frequency thereof independent of ambient light and of the time derivative of the lamp current.

* * * * *